United States Patent [19]

Spratt

[11] Patent Number: 4,948,989

[45] Date of Patent: Aug. 14, 1990

[54] RADIATION-HARDENED TEMPERATURE-COMPENSATED VOLTAGE REFERENCE

[75] Inventor: James P. Spratt, Rancho La Costa, Calif.

[73] Assignee: Science Applications International Corporation, San Diego, Calif.

[21] Appl. No.: 304,502

[22] Filed: Jan. 31, 1989

[51] Int. Cl.[5] ..... G05F 3/18

[52] U.S. Cl. ..... 307/296.6; 307/285; 307/310; 307/296.1; 307/296.2; 307/317.1; 307/318; 307/322; 307/317.2; 323/229; 357/12; 357/13

[58] Field of Search ..... 307/296.6, 285, 310, 307/296.1, 296.2, 302, 317.1, 317.2, 318, 322, 491; 323/229, 231, 907; 357/12, 13

[56] References Cited

U.S. PATENT DOCUMENTS

| | | | |
|---|---|---|---|
| 3,248,572 | 4/1966 | Widmer | 307/310 |
| 3,502,912 | 3/1970 | McAvoy | 307/310 |
| 3,626,389 | 12/1971 | Waaben | 307/317.2 |
| 4,030,023 | 6/1977 | Keith | 307/296.6 |
| 4,785,230 | 11/1988 | Ovens et al. | 307/317.2 |

FOREIGN PATENT DOCUMENTS

| | | | |
|---|---|---|---|
| 0232053 | 2/1964 | Austria | 307/322 |
| 0055624 | 4/1980 | Japan | 307/317.2 |
| 0712893 | 1/1980 | U.S.S.R. | 307/317.2 |

OTHER PUBLICATIONS

Millman and Taub; Pulse, Digital, and Switching Waveforms; pp. 185–189 "Avalanche Diodes".

E. J. Trainor, Expanded Scale Voltmeter Western Electric Technical Digest No. 2, Apr. 1966.

Motorola Rectifier and Zener Diode Data Book, pp. 6–2, 6–3 (1982).

Fair, et al., "Zener and Avalanche Breakdown in As-Implanted Low Voltage Si n–p junctions", IEEE Trans. Elec. Devices, vol. ED–23, No. 5, pp. 512–518 (1976).

Sze, Physics of Semiconductor Devices, 2nd Ed., John Wiley & Sons, pp. 84–89 (1969).

Donovan et al., "A Survey of the Vulnerability of Contemporary Semiconductor Components to Nuclear Radiation", Technical Report AFAL–TR–74–61, Air Force Avionics Laboratory, Wright-Patterson Air Force Base, Ohio, pp. 39–47, 170–172, 253–259 (1974).

Millward "Neutron Hardness Assurance Considerations for Temperature Compensated Reference Diode," IEEE Trans Nuclear Sci, vol. NS–25, No. 6 pp. 1517–1521 (Dec. 1978).

George et al., "Radiation Hardened O–TC Zener Diodes" Technical Report AECRL–70–0166 (Gov't Contract No. F19628–68–C–0296; Project No. 672A), 75 pages (Nov. 1969).

*Primary Examiner*—Stanley D. Miller
*Assistant Examiner*—T. Cunningham
*Attorney, Agent, or Firm*—Fitch, Even, Tabin & Flannery

[57] ABSTRACT

A radiation-hardened temperature-compensated precision voltage reference includes two diodes connected in series having a prescribed operating current ($I_B$) flowing therethrough. In one embodiment, a first of the two diodes comprises a reversed-biased avalanche diode (32), and a second of the two diodes comprises a forward biased Schottky diode (30). In another embodiment, a reversed biased avalanche diode (42) is connected in series with a reverse biased tunneling diode (40). Both diodes of either embodiment include opposite and offsetting temperature and neutron coefficients of voltage. A method of adjusting the temperature and neutron coefficients of at least one of the two diodes includes selectively adjusting the current density of one of the diodes by selectively trimming the area of the diode dipole.

26 Claims, 4 Drawing Sheets

RADIATION-HARDENED TEMPERATURE-COMPENSATED VOLTAGE REFERENCE

BACKGROUND OF THE INVENTION

The present invention relates to voltage reference circuits and devices, and more particularly to a radiation-hardened temperature-compensated voltage reference device comprising a pair of series-connected diodes, including a method of matching the temperature coefficients of voltage of the diodes, and controlling the neutron coefficients of voltage of the diodes.

Many electronic circuits require one or more voltage reference sources that provide a constant, stable, voltage value for use within the circuit as a reference voltage from which the operation of the circuit, or portions of the circuit, can be controlled. Often, the voltage reference source must be a precision reference source that provides the desired voltage value regardless of changes in the environment to which the voltage reference source is exposed. The most common change in environment that can affect a voltage reference source is temperature. However, changes in neutron fluence (radiation levels to which the circuit is exposed) can also have an adverse impact on the voltage value provided. Those skilled in the art have long sought for a precision voltage reference source that is immune to changes in both temperature and neutron fluence.

The most widely used approach to temperature compensated precision voltage references is a reverse biased avalanche diode in series with a forward biased P-N junction diode. The voltage arising across this series combination, when a specified current is allowed to flow therethrough, is quite insensitive to temperature variations. This configuration achieves temperature compensation by offsetting the positive temperature coefficient of voltage of the avalanche diode with the negative temperature coefficient of voltage of the forward biased diode. By this means, temperature coefficients as low as a few parts per million (ppm) can be achieved. Unfortunately, however, exposure to the adverse effects of neutron irradiation significantly reduces the performance of such circuits at neutron fluence levels which are unacceptably low. Thus, even though a reverse-biased voltage reference diode in series with a forward-biased p-n diode may provide a temperature compensated voltage reference source, such source is not necessarily stable when exposed to radiation.

Voltage reference diodes typically comprise a p-n junction that is operated in the reverse direction at sufficient bias to cause either avalanche or zener breakdown. Advantageously, the desired property of a voltage reference diode is that very little current flows therethrough until a particular reverse voltage, termed the "breakdown voltage" ($V_{BR}$) is reached. At the breakdown voltage, either the zener or the avalanche processes cause the effective impedance of the diode to become very small, thereby allowing a large range of currents to flow through the diode without significantly altering the voltage drop across the diode. The effect of this very small impedance is to maintain the voltage drop across the reference diode essentially constant for a large range of current values flowing through the reference diode.

Voltage reference diodes are used as a voltage reference source in circuits where a constant voltage reference is required even though there may be variations in the power supply voltage used to reverse bias the p-n junction of the diode. However, so long as the voltage applied to the diode biasing circuit remains greater than the breakdown voltage, the voltage measured across the diode (i.e., the reference voltage) remains essentially constant. For many applications, however, even small variations in the reference voltage destroys the usefulness of the reference diode.

Changes in the breakdown voltage caused by temperature variations can be offset (compensated for) by including a forward biased diode in series with the reverse-biased voltage reference diode, as has been indicated. However, the breakdown voltage of an avalanche reference diode depends inversely upon impurity doping levels. Unfortunately, these doping levels can be altered when the device is exposed to radiation (neutron fluence). In effect, neutron-induced traps decrease the effective doping levels of the p-n junction, which in turn causes the breakdown voltage to increase. Moreover, exposure to radiation causes the density of the scattering centers within the p-n junction to increase, which also disadvantageously causes the breakdown voltage to increase.

Similarly, the breakdown voltage of a zener reference diode is also adversely affected by exposure to radiation. However, in a zener diode, the breakdown voltage decreases with neutron fluence. Zener breakdown results from band to band tunneling, i.e., carriers tunneling from the conduction band of a heavily doped n-region across the forbidden gap to the valence band of a heavily doped p-region. The actual breakdown voltage exhibited by the zener diode is at least partially a function of the amount of tunneling that occurs. A large amount of tunneling results in a lower breakdown voltage than does a lesser amount of tunneling. Neutron fluence causes increased traps in the forbidden gap. These traps provide additional sites to which the carriers can tunnel. Hence, neutron fluence tends to decrease the breakdown voltage of a zener diode.

It is also known in the art to employ two diodes in series for the purpose of providing some measure of radiation hardening. (As used herein, "radiation hardening" refers to the ability of a device to withstand neutron fluence without being adversely affected.) A first diode is forward biased and a second diode, an avalanche breakdown diode, is reversed biased. With low forward current operation, the voltage of the forward biased diode decreases with neutron fluence, while the avalanche breakdown voltage of the reverse biased junction increases with neutron fluence. These effects compensate each other, and provide some measure of radiation hardening.

Unfortunately, at low to moderate neutron fluences, the lifetime degradation of the forward biased diode in such a series diode combination dominates, and the desired compensation is lost (or at least reduced below acceptable levels). The shift in reference voltage for neutron fluences in the range of $10^{12}$ n/cm$^2$ to $10^{13}$ n/cm$^2$ for such prior art diode combinations can vary over a wide range. While gold doping of the forward biased diode (or other means) may be used to "harden" the device to reduce the neutron-induced shift of the forward voltage drop, a voltage change of 5 millivolts or more can still be expected for neutron fluences at levels of $10^{14}$ n/cm$^2$. For many high precision applications, a reference voltage is required that is stable to within plus or minus one millivolt (mv) or less when exposed to a high neutron fluence ($>10^{14}$ n/cm$^2$). Hence, there is a need in the art for a more stable radiation-hardened temperature compensated voltage reference source.

SUMMARY OF THE INVENTION

The present invention provides a radiation-hardened temperature-compensated voltage reference source or device that addresses the above-identified needs. One embodiment of the present invention comprises a forward biased Schottky diode in series with a reversed biased avalanche diode. Advantageously, the Schottky diode exhibits a forward bias voltage that is substantially independent of neutron fluence up to values of $1\times10^{14}$ n/cm$^2$ the above. This is because the forward current of a Schottky diode is a function only of the properties of the metal silicon interface, not the bulk silicon. Yet the Schottky diode exhibits current-voltage (I-V) characteristics nearly identical to that of a p-n diode. Hence, replacement of the forward biased p-n junction of a conventional temperature compensated voltage reference with a Schottky diode provides a radiation-hardened voltage reference having neutron induced voltage shifts on the order of only one millivolt at radiation levels of $1\times10^{14}$ n/cm$^2$. Temperature compensation is realized by selectively matching the temperature coefficients of voltage of both the Schottky and avalanche diodes using the method described below or an equivalent method.

Another embodiment of the invention provides a radiation-hardened temperature-compensated voltage reference made up of a reversed biased zener or tunneling diode in series with a reversed biased avalanche diode. Advantageously, the reversed bias zener or tunneling diode exhibits a negative neutron coefficient of voltage which offsets the positive neutron coefficient of the avalanche diode. Temperature compensation is achieved by matching the temperature coefficients of the two diodes as described below.

The invention further includes a method of matching the temperature coefficients of voltage of a pair of diodes connected in series, where the pair of diodes comprise a reverse-biased avalanche diode and one of either; (1) a reversed biased zener or tunneling diode, or (2) a forward-biased Schottky diode. Use of this method advantageously allows two matched diodes to be used in one of the radiation-hardened embodiments described above, thereby providing a voltage reference that is both temperature compensated and radiation hardened. The method assumes that the temperature coefficient of voltage varies as a function of the current density through the dipole area of the respective diodes. The method includes the steps of: (1) passing an electrical current of a predetermined level through the series diode circuit; (2) measuring the temperature coefficient of voltage of each diode while the prescribed current is passing therethrough; and (3) adjusting the size of, and thereby the current density, through the dipole area of one or both of the diodes as necessary in order to match the temperature coefficients of voltage of each diode at the predetermined current level. Advantageously, where one of the diodes comprises a number of small area diodes in parallel, connected by an aluminum (or other conductive) trace over the insulating silicon dioxide layer on the surface of the silicon chip on which the diodes are fabricated, adjustment of the dipole area size may be accomplished through a precision trimming process that selectively disconnects one or more diodes from the original parallel connection. Such trimming can be carried out, for example, with a laser.

BRIEF DESCRIPTION OF THE DRAWINGS

The above and other features and advantages of the present invention will be more apparent from the following more particular description thereof presented in conjunction with the following drawings wherein.

DETAILED DESCRIPTION OF THE INVENTION

The following description presents the best contemplated mode for practicing the invention. This description is not to be taken in a limiting sense but is made merely for the purpose of describing the general principles of the invention. The scope of the invention should be ascertained with reference to the appended claims.

Figure 1:
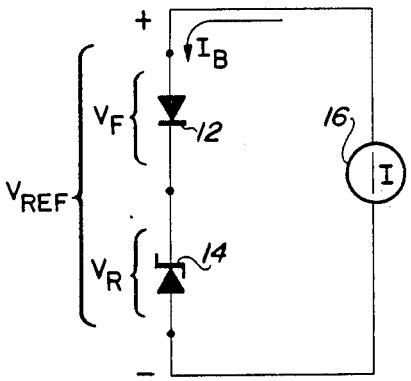
FIG. 1 (PRIOR ART)
FIG. 1 is a schematic diagram of a prior art temperature compensated voltage reference circuit.

Referring first to FIG. 1, there is shown a schematic diagram of a prior art temperature compensated voltage reference circuit. This circuit includes a conventional p-n forward-biased diode 12 in series with a reverse-biased voltage reference diode 14. A current source 16 provides a bias current, $I_B$, that flows through both the diode 12 and the diode 14. Conventional circuits can be used to provide the current source 16. When a current $I_B$ is flowing through the circuit as shown, a voltage is measured across both diodes. The voltage across the diode 12 is identified as $V_F$, and the voltage across the reference diode is identified as $V_R$. The two voltages, $V_F$ plus $V_R$, combine to provide a reference voltage, $V_{REF}$, which reference voltage is the voltage provided by the circuit as a reference voltage.

Figure 2A:
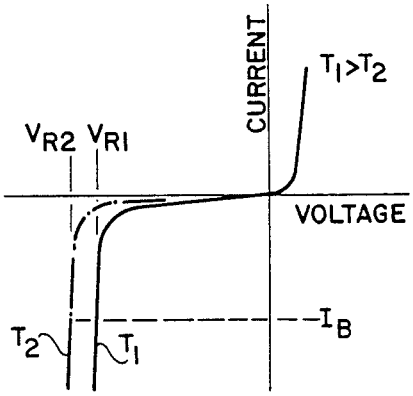
FIG. 2A (PRIOR ART)
FIGS. 2A and 2B are current-voltage curves for the diodes used in the circuit of FIG. 1.
Figure 2B:
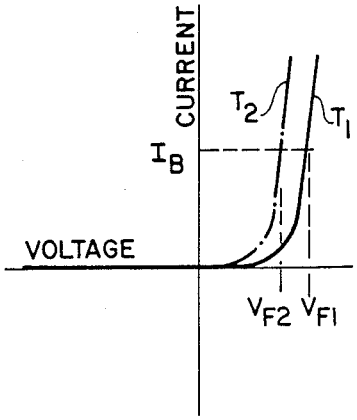
FIG. 2B (PRIOR ART)

Advantageously, as has been previously explained, the circuit shown in FIG. 1 provides a reference voltage that is substantially independent of variations in temperature. This is because the voltage drop across the diode 12, $V_F$, although varying with temperature in accordance with well-known principles, is compensated for by the change in the voltage across the voltage reference diode 14, $V_R$. Qualitatively, the manner in which these voltages change with temperature are illustrated in FIGS. 2A and 2B. FIG. 2A provides the voltage current relationship for the reference diode 14. This diode is operated in a reverse-biased mode at a current operating point identified as $-I_B$. At a temperature $T_1$, the voltage drop across the diode is therefore $V_{R1}$. At a different temperature $T_2$, the voltage drop across the diode 14 has shifted to the left, as shown in FIG. 2A, thereby providing a reference voltage $V_{R2}$.

At the same time that the temperature causes a shift in the reference voltage of the voltage reference diode 14, a similar, but opposite, shift in voltage occurs across the forward-biased diode 12. This effect is qualitatively illustrated in FIG. 2B, which Figure also illustrates the voltage current relationship of a typical diode, such as the diode 12. At an operating current $I_B$ and a temperature $T_1$, the voltage drop across the diode is $V_{F1}$. As the temperature changes to $T_2$, the voltage drop across the diode decreases to $V_{F2}$. Advantageously, the difference in the voltage drop $V_{F1}$ minus $V_{F2}$ is substantially the same over a wide range of temperatures as the difference in the voltage drop $V_{R1}$ minus $V_{R2}$, but of an opposite polarity. Hence, the two changes in voltage drop effectively compensate each other, thereby maintaining the reference voltage, $V_{REF}$, at a substantially constant value.

At this point it will be helpful to define some terms that will be used throughout the application. As is known to those skilled in the art, a semiconductor diode is formed by forming a p-n junction in the silicon by impurity doping. That is, a certain region of the semiconductor wafer is doped with a donor dopant, such as arsenic, and the other region is doped with an acceptor dopant, such as boron. If the donor impurity concentration level is identified as $N_D$, and the acceptor impurity concentration is identified as $N_A$, then the net impurity concentration, $N_D$-$N_A$, is approximately linear on either side of the doping cross-over point, that is the point where $N_D$ equals $N_A$. The gradient of the net impurity concentration at this point can be mathematically expressed as:

$$a = \frac{d(N_D - N_A)}{dx}. \qquad \text{(Equation 1)}$$

This gradient is an important parameter in determining the magnitude of the electric field that separates the p and n regions of the semiconductor. For any given level of doping concentration, this gradient is substantially constant, and defines a controllable parameter known as the "grade constant".

In operation of a semiconductor diode, a narrow region of silicon on either side of the doping cross-over plane (known as the "depletion layer") is depleted of mobile carriers by diffusion of charge carriers from the donor side of the junction over to the acceptor side, and vice-versa. This depleted layer is sometimes referred to in the literature as the "space-charge layer" or the "dipole layer". The width of this dipole layer varies as a function of the doping concentration levels of the respective p- and n-doped semiconductor materials. The application of an external electric field can cause this width to decrease or increase, depending upon the magnitude and polarity of the applied electric field (bias potential). When the applied bias potential is of a polarity to decrease the dipole layer width, the dipole is said to be forward-biased, and current flow is increased. When the applied voltage is of a polarity to increase the dipole layer width, the diode is said to be back-biased, or reverse-biased, and current flow is reduced. Thus, the diode has asymmetric electrical impedance, as shown in FIGS. 2A and 2B. At high electric field strength, however, the current blocking action of the junction is affected by the occurrence of diode breakdown mechanisms, which make current flow occur by processes referred to as "avalanche" or "tunneling". These processes are well-known and documented in the art.

The dipole layer that separates the p and n doped materials is located in an area through which the various charge carriers (holes or electrons) must pass. The number of charge carriers that flow through the dipole area defines a parameter known as "current density". Desired values of current density and grade constant can typically be designed into a given diode during the manufacturing process of the diode (such as by controlling the grade constant or dipole area) or can be otherwise controlled during operation of the diode (such as by controlling the amount of current flowing therethrough). All three of these parameters —grade constant, dipole area and current—will be referenced hereafter.

The device shown in FIG. 1 provides a fairly stable temperature compensated voltage reference source. However, as has been indicated, such a circuit is not immune to the effects of radiation. That is, the presence of neutrons in the p and/or n doped materials, or at the p-n junction, can adversely affect the value of the voltage that is provided. The mechanisms responsible for this change in reference voltage as a function of neutron fluence have been previously described in the Background portion of this application, and are documented in the art. It suffices to say that designers have long sought for a voltage reference circuit that provides not only temperature compensation but also neutron fluence compensation.

Figure 3:
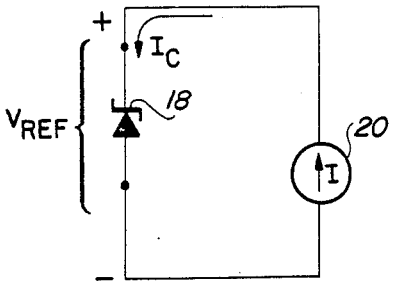
FIG. 3 (PRIOR ART)
FIG. 3 is a schematic diagram of a "crossover" reference diode of the prior art.
Figure 4:
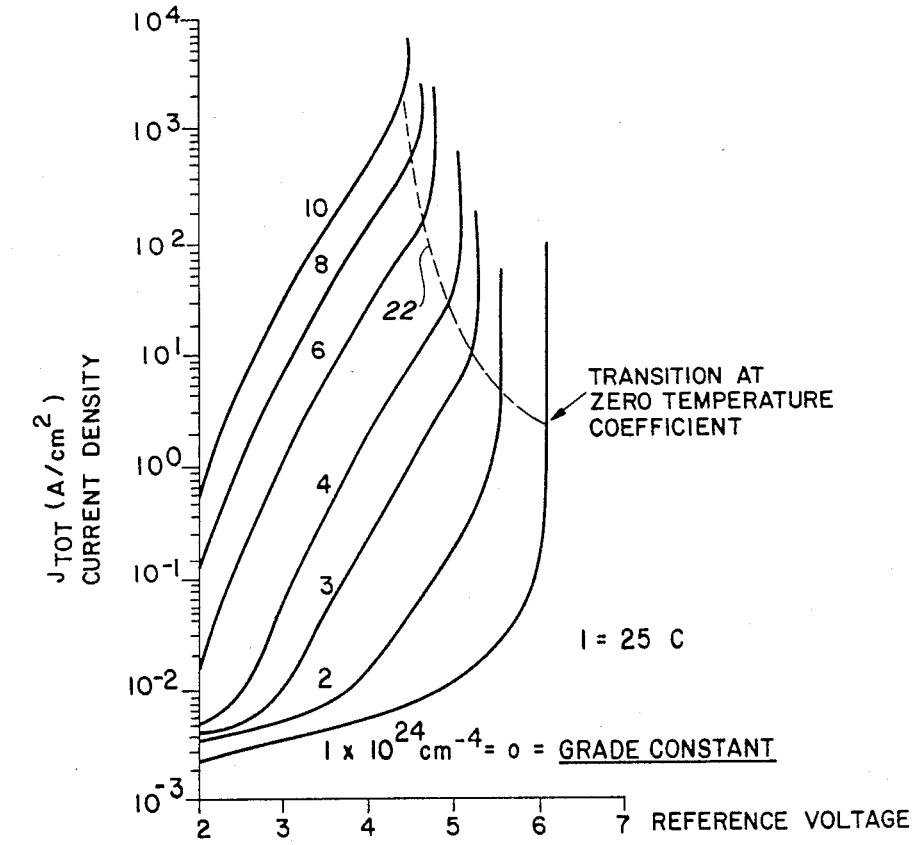
FIG. 4 (PRIOR ART)
FIG. 4 is a graph depicting the reference voltage versus current density of a reference diode as a function of grade constant.

One prior art approach for providing a radiation-hardened voltage reference source is shown in FIG. 3. Essentially, this approach consists of a heavily doped single diode that provides a sufficiently low resistivity so that the tunneling process and the avalanche process can occur concurrently when the diode is reverse-biased. Operation of the circuit of FIG. 3 is further understood with reference to FIG. 4. FIG. 4 depicts the reference voltage as a function of current density for various values of grade constant for a reverse-biased reference diode. The dashed curve 22 superimposed on this set of I-V curves is the loci of points where tunneling current and avalanche current are equal as grade constant is varied. (As has been indicated, grade constant is a fabrication parameter used in the construction of a diode. The manner in which grade constant can be varied during the fabrication process is well documented in the art. See, e.g., Fair et al, "Zener and Avalanche Breakdown in As-Implanted Low-Voltage Si n-p Junctions", IEEE Transactions Electron Devices, ED-25, No. 5, May 1976, pp 512–518.) For voltages above the dashed line or curve 22, avalanche current dominates. For voltages below the dashed line 22, tunneling current dominates. Along the locus 22, the temperature coefficient of voltage is exactly zero. Hence, by balancing the tunneling and avalanche currents in a single diode, a near-zero temperature coefficient of voltage can be realized. Further, because the neutron coefficient of voltage or a tunnel diode is approximately equal and opposite to that of an avalanche diode, such operation provides both temperature compensation and neutron fluence compensation.

Diodes in which the tunneling and avalanche currents are balanced are called "cross-over" diodes, and such a cross-over diode 18 is shown in FIG. 3. Conceptually, such a diode is really two diodes in parallel, one a tunneling diode, and the other an avalanche diode. As long as the operating point remains on the locus 22 (FIG. 4) such a cross-over diode can provide a measure of temperature compensation and radiation hardness. However, the cross-over diode has a serious disadvantage due to the fact that in the parallel configuration, the partitioning of current density between the two current flow mechanisms is not controllable. That is, if the diode is initially biased exactly at the cross-over point (around the locus 22) the tunneling and avalanche currents are equal and the desired temperature and neutron compensation will be achieved. However, as neutron fluence causes the tunnel voltage to drop, the current carried by the tunneling diode will also drop, while the current carried by the avalanche diode will rise. This is because the total current must be constant. Since the avalanche voltage rises as a result of neutron fluence, the voltage across the reference diode will rise at a rate dominated by the avalanche diode. Such voltage shifts are unacceptably high for many precision applications.

Figure 5:
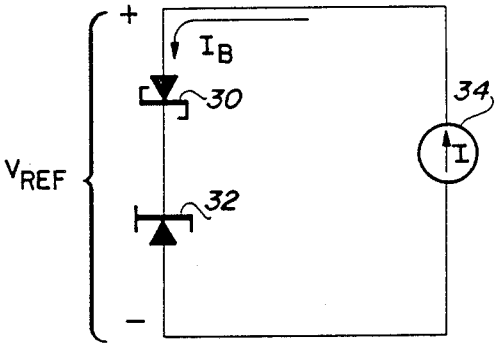
FIG. 5 is a schematic diagram of one embodiment of the radiation-hardened, temperature compensated voltage reference source of the present invention.

Referring next to FIG. 5, a schematic diagram of one embodiment of a radiation-hardened temperature-compensated reference source in accordance with the present invention is shown. This embodiment includes a forward-biased Schottky diode 30 in series with an avalanche diode 32. A conventional current source 34 provides a bias current $I_B$ to flow through the Schottky diode 30 and the avalanche diode 32. The voltage developed across the series combination of the two diodes 30 and 32, $V_{REF}$, thus serves as the voltage reference developed by the circuit.

As is evident from a comparison of FIG. 1 and FIG. 5, the only difference between the voltage reference circuit of FIG. 5 and that of the prior art is the replacement of a conventional p-n diode 12 with a Schottky diode 30. This seemingly simple substitution, however, provides significant benefits not previously available relative to the radiation hardness of the circuit. For the prior art circuit of FIG. 1, it has been shown that such circuit begins to suffer in performance when exposed to neutron fluences as low as $2\times10^{12}$ n/cm$^2$. See, e.g., Millward "Neutron Hardness Assurance Considerations for Temperature Compensated Reference Diodes", IEEE Trans. Nuclear Science, NS-25, No. 6, 1978, pp 1517–21. This degradation is caused by the reduction of the minority carrier lifetime of the semiconductor used for the forward-biased p-n diode 12. Advantageously, a Schottky diode 30 provides a forward-biased junction in a structure independent of minority carrier lifetime of the semiconductor. Hence, improvement in neutron hardness is accomplished by use of the Schottky diode as shown in FIG. 5.

To illustrate why the structure of a Schottky diode provides a forward-biased junction diode that is independent of minority carrier lifetime of the semiconductor, an examination of the current flowing through both a conventional p-n forward-biased diode and a Schottky diode is instructive. The current density of the conventional p-n forward-biased diode is:

$$j = \left[\frac{qD_p P_{no}}{L_p} + \frac{qD_n N_{po}}{L_n}\right][e^{qV/KT} - 1] \qquad \text{(Equation 2)}$$

where
$j$ = current density (amps/cm$^2$)
$q$ = electronic charge
$D_p$ = diffusion constant of holes in N-region
$P_{no}$ = equilibrium hole concentration in N-region
$L_p$ = diffusion length of holes in N-region
$D_n$ = diffusion constant of electrons in P-region
$N_{po}$ = equilibrium electron concentration in P-region
$L_n$ = diffusion length of holes in P-region
$V$ = applied voltage across p–n junction
$K$ = Boltzmann's constant
$T$ = absolute temperature (°K.)

In contrast, the current density through a forward-biased Schottky diode may be expressed by $$j = A^*T^2e^{(-q\phi Bn/KT)}\,[e^{qV/KT} - 1] \qquad \text{(Equation 3)}$$

where

| | | |
|---|---|---|
| $j$ | = | current density |
| $A^*$ | = | modified Richardson constant ($\approx$90 amps/cm$^2$/°K.$^2$) |
| $T$ | = | absolute temperature (°K.) |
| $V$ | = | applied voltage |
| $q$ | = | electronic charge |
| $\phi_{Bn}$ | = | height of electron potential barrier at metal-semiconductor interface |
| $K$ | = | Boltzmann's constant |

Analysis of the pre-exponential terms and Equations 2 and 3 show that both behave similarly in their temperature dependence. Unlike conventional diodes, however, the voltage across a Schottky diode at a specified temperature and current is independent of that property of a semiconductor which is most severely degraded when exposed to neutron fluence, namely the minority carrier lifetime. In this regard, it is noted that the diffusion length of the holes and equations, $L_p$ and $L_n$ in Equation 2, may be expressed as $$L_p=[D_p\,\pi_p]^{\frac{1}{2}} \qquad (4)$$

and $$L_n=[D_n\,\pi_n]^{\frac{1}{2}} \qquad (5)$$

where
$\pi_p$=lifetime of holes in N-region, and
$\pi_n$=lifetime of electrons in P-region Hence, substitution of such diodes for conventional p-n junction diodes permits the retention of the desirable features of temperature compensation, but with the considerable improvement in the neutron tolerance.

Advantageously, the use of a Schottky diode 30 in series with an avalanche diode 32, as shown in FIG. 5, provides a very stable reference voltage, $V_{REF}$, up to fluence levels in the range of $3\times10^{13}$ n/cm$^2$ to $1\times10^{14}$ n/cm$^2$. Neutron fluences exceeding $1\times10^{14}$ n/cm$^2$, however, cause a different failure mechanism to occur, viz. the resistivity of the semiconductor begins to degrade. Unfortunately, this degradation of the resistivity is accompanied by a corresponding degradation in the voltage reference. Nonetheless, through the replacement of the conventional p-n diode 12 (FIG. 1) with the Schottky diode 30 (FIG. 5), a significant improvement in neutron hardness is achieved that is suitable for most technical, avionic, and low-end strategic military applications.

It is noted that commercially available diodes can be used to fabricate the circuit shown in FIG. 5. For example, the Schottky diode 30 can be a 1N5711 diode manufactured by Hewlett-Packard. The avalanche diode 32 can be, for example, a ten-volt ¼M10Z10 diode manufactured by Motorola. When a bias current of 10 ma flows through the circuit and when the circuit is exposed to neutron fluences up to $1\times10^{14}$ cm$^2$, and temperature ranges from −25° C. to +125° C., the voltage reference change of the circuit remains less than 10 mv, with a temperature coefficient of 0.001%/°C.

As has been indicated, it is known in the art to modify a conventional diode 12 (FIG. 1) in order to improve neutron hardness. The most widely used of these modifications is that of doping the diode 12 with gold impurities. See, e.g. George et al., "Radiation Hardened OTC Zener Diode", Technical Report AFCRL-70-0166, Nov. 1969. Gold impurities are known to reduce the minority carrier lifetime in diodes, in a manner similar to the effects of neutron damage. Thus, "gold doped" diodes behave as if they had been pre-irradiated, and will therefore tolerate neutron exposure to a higher level. This advantage is achieved at a substantial cost in process compatibility, however, since "gold doping" is incompatible with every integrated circuit process technology currently in use. Thus, the gold doping approach can be implemented only with discrete devices. Furthermore, the cost of these devices is substantially higher than that of discrete conventional diodes, often by a factor of 100 times or more. Thus, the use of Schottky diodes for gold doped diodes, as proposed herein, advantageously permits retention of the neutron hardness desired, but without the loss of process compatibility associated with gold doped diodes, and at a much more reasonable cost.

As indicated above, if the neutron fluence to which the voltage reference circuit is to be exposed will exceed about $1\times10^{14}$ n/cm$^2$, then neither the forward-biased Schottky diodes nor gold doped diodes are adequate, since at these levels of radiation, a secondary damage mechanism (resistivity change) becomes significant. Resistivity changes caused by neutron damage may be minimized by making the initial resistivity as low as possible. However, this forces the breakdown voltage of the reverse-biased diodes to be low.

Figure 6:
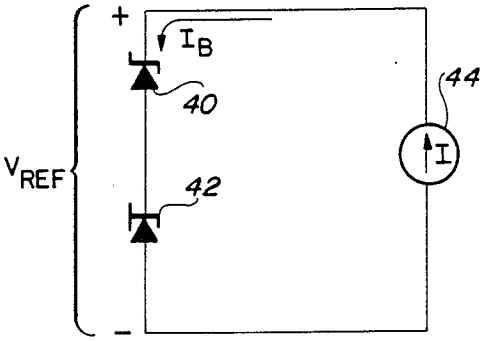
FIG. 6 is a schematic diagram of another embodiment of the radiation temperature compensated voltage reference source of the present invention.

To address the need for a temperature-compensated, radiation-hardened voltage reference device that provides a constant voltage even when exposed to high levels of neutron fluence (e.g., greater than $1\times10^{14}$ n/cm$^2$), the embodiment of the present invention shown in FIG. 6 is proposed. This embodiment includes a reverse-biased tunneling diode 40 in series with a reverse-biased avalanche diode 42. A current source 44 develops a bias current $I_B$ that flows through both diodes. The voltage, $V_{REF}$, developed across the series combination of the diodes 40 and 42 thus provides the voltage reference level generated by the circuit.

The circuit configuration of FIG. 6 advantageously avoids the problem of uncontrolled shifts of current between parallel diodes, discussed above in connection to FIGS. 3 and 4. As shown in Table 1, for a constant current density, both the temperature coefficient of voltage and the neutron coefficient of voltage for the tunneling process and the avalanche process compensate almost exactly. Thus, by maintaining the current density at a constant level, a highly precise voltage reference is achieved. In the series configuration, the current flow is identical for both devices, and this current flow can be maintained constant by means of conventional circuit bias techniques. Thus, the current density is controlled by controlling the bias current and by selectively setting or specifying the dipole area of both devices. Advantageously, the voltage reference circuit shown in FIG. 6 reduces both the temperature coefficient of voltage and the neutron coefficient of voltage to acceptable levels. For example, if the diode 40 in FIG. 6 is realized with a ¼M3.9AZ10 diode manufactured by Motorola; and if the diode 42 is realized with a ¼M7.5Z10 diode also manufactured by Motorola; and if a current $I_B$ of 10 ma is caused to flow through both diodes; and assuming both diodes are matched relative to their temperature coefficients of voltage using a method as described below, or an equivalent technique; an overall temperature coefficient of voltage on the order of one mv/°C, over the temperature range of −25° C. to +125° C.; and an overall neutron coefficient of voltage of less than 100 ppm, for exposure to neutron fluences up to $1\times10^{15}$ n/cm$^2$, can be achieved for the complete circuit.

TABLE 1

TEMPERATURE AND NEUTRON EFFECTS ON REFERENCE DIODE COMPONENTS

| COMPONENT | Neutron Coefficient | Temperature Coefficient | Polarity |
|---|---|---|---|
| *Reverse Biased Diode | | | |
| Avalanche diode | ≈ +200 ppm | ≈ +ppm/°C. | Negative |
| Zener diode | ≈ −200 ppm | ≈ −700 ppm/°C. | Negative |
| *Forward Biased Diode | N.A. | Negative | Positive |

It is noted that neutron exposure may damage semiconductor devices by two separate mechanisms, namely displacement damage, and ionization. Displacement damage occurs when a neutron collides with a silicon atom, and displaces it from its lattice position to an interstitial position. The silicon atom involved in the collision acquires energy from the neutron, and loses it in slowing down by causing further displacements, or by ionizing the surrounding material. The partitioning of the energy of the knock-on atom can be analyzed, and it can be determined exactly how much of the neutron's energy is dissipated in the production of displacements, and how much is dissipated in ionization.

Displaced atoms will, after they have lost the energy of the collision, find themselves in new positions in the crystal lattice, where they will remain. Thus, displacement damage is permanent. Ionization damage, however, is an excitation of the electronic population of the material, and will return to equilibrium with a time constant characteristic of the material. The time constant of semiconductors is quite short, typically being in the hundreds of nanoseconds. The time constant of insulators, on the other hand, such as the oxides usually found on the surface of semiconductors, can be extremely long (perhaps as long as years). Hence, ionization effects in the semiconductor can be neglected (except for transient affects), while ionization effects of the oxides can be considered as permanent.

Figure 7:
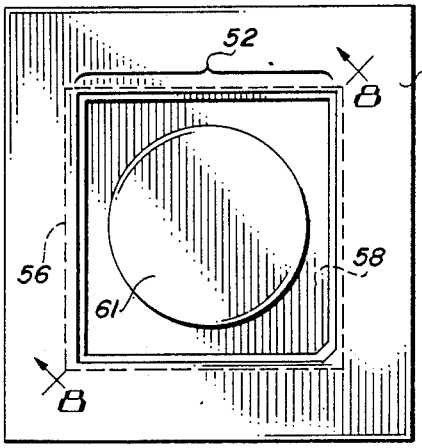
FIG. 7 (PRIOR ART)
FIG. 7 is a top view of a diffused wafer containing a "buried diode" therein in accordance with one feature of the present invention.
Figure 8:
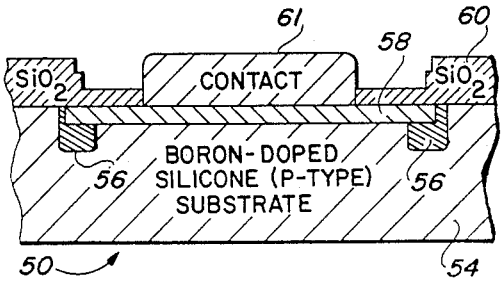
FIG. 8 (PRIOR ART)
FIG. 8 is a sectional view taken along the line 8—8 of FIG. 7.

Recognizing that ionizing effects in oxides are effectively permanent, the present invention contemplates using an oxide layer to protect the more sensitive semiconductor portions of a diode. This is achieved through a mechanism identified as a "buried diode". A proposed structure for a buried diode is shown in FIGS. 7 and 8. FIG. 7 is a top view of a diffused wafer 50 containing a buried diode 52 therein. FIG. 8 is a sectional view taken along the line 8—8 of FIG. 7. As seen best in FIG. 8, the diode structure includes a silicon substrate doped with boron, thereby providing a p-type substrate 54. A collar region 56 surrounds the substrate 54 and is doped with phosphorous (n-type). This region 56 is further in contact with an arsenic (n-type) doped region 58, located inside of the collar region 56. A layer of silicon dioxide 60 overlays the phosphorous (n-type) and arsenic (n-type) doped regions, except for a center metallic contact 61.

In the structure shown in FIG. 8, the phosphorous doped portion 56 of the cathode is less effective in controlling current flow than is the arsenic doped portion 58. Hence, by increasing the phosphorous doping concentration above that of the arsenic doped portion, the controlling portion of the cathode can be "buried" beneath the silicon oxide layer 60. This silicon oxide layer thus provides a measure of protection from neutron fluences that would not otherwise be available. Hence, for applications and environments where surface damage to the semiconductor devices poses a significant problem, the "buried diode" configuration shown in FIGS. 7 and 8 provides some measure of additional protection.

As is evident from the above description of the present invention, the voltages developed across both the tunnel diode and the avalanche diode are highly dependent on the current (more precisely, current density) flowing through these devices. Advantageously, the present invention causes the same current to flow through both diode by virtue of the series configuration that is used. However, the present invention contemplates that the current density of one or both of the diodes of the series configuration can be adjusted in order to precisely match the temperature and neutron coefficients of voltage. (The "current density" is defined as the amount of charge flowing through a given dipole area per unit time; and is usually expressed in units of amps/cmz or coulombs/sec-cm$^2$.

Figure 9A:
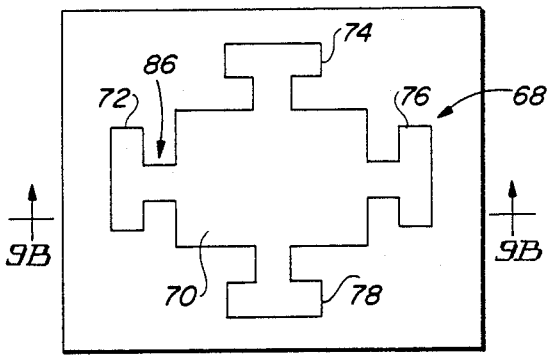
FIGS. 9A and 9B are top and sectional views, respectively, of a wafer containing an avalanche diode in accordance with the present invention, which avalanche diode comprises a plurality of avalanche diodes connected in parallel.
Figure 9B:
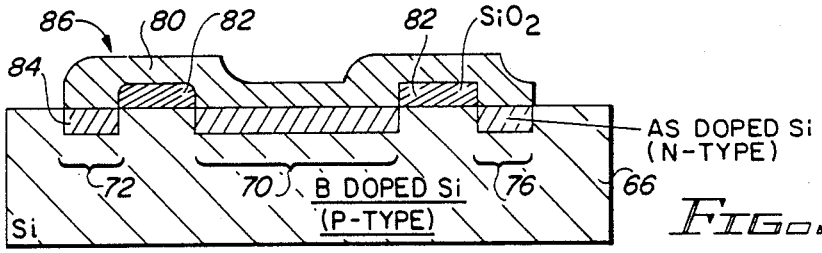

One method of adjusting the current density in a diode is depicted in FIGS. 9A and 9B. These figures are top and sectional views, respectively, of a silicon wafer 66 in which an avalanche diode 68 has been fabricated. The avalanche diode 68 includes a large centrally located diode 70 in parallel with four smaller diode structures 72, 74, 76, and 78. An aluminum trace 80 placed over the silicon dioxide insulating layer 82 on the surface of the wafer 66, connects the diode structures 70–78 in parallel. Note that each diode 70–78 comprises an n-doped region 84 in contact with a p-doped region 66, thereby forming the desired p-n junction. As shown, the effective dipole area of the central diode 70 is much larger than the dipole areas associated with the smaller diodes 72–76. However, each dipole area contributes to the overall current density of the diode. Thus, by selectively cutting or otherwise breaking the aluminum trace 80, one or more of the smaller diodes 72–78 can be selectively disconnected from the central diode 70. In this manner, the dipole area, and hence the current density, can be selectively trimmed in order to achieve a desired current density.

For example, assume that the dipole area of the central diode 70 is $6\times10^{-5}$ cm$^2$, while the areas of the outrigger diodes 72–78 are $1\times10^{-5}$ cm$^2$ each. With all four outrigger diodes connected to the central diode 70 by means of the aluminum metallization 80 over the field oxide, the active area of the avalanche diode is thus $10\times10^{-5}$ cm$^2$. However, by selectively trimming one or more of the smaller outrigger diodes 72–78, so as to disconnect one or more of these diodes from the central diode 70, the effective dipole area can be selectively configured to be $10\times10^{-5}$ cm$^2$, $9\times10^{-5}$ cm$^2$, $8\times10^{-5}$ cm$^2$, $7\times10^{-5}$ cm$^2$, or $6\times10^{-5}$ cm$^2$. Thus, trimming of the area of the dipole is used to selectively adjust the current density so that a desired match of temperature and/or neutron coefficients of voltage can be achieved.

Any suitable technique could be used to perform the trimming process above-described. For example, a laser beam could be focused on the aluminum trace(s) connecting the outrigger diodes to electrically isolate the diodes by burning and vaporizing the traces. Laser trimming techniques are known in the art, and will not be described further herein. It is further noted that semiconductor processing techniques, i.e., those methods and processes used to construct a diode or transistor in a semiconductor substrate, are also known in the art.

Figure 10A:
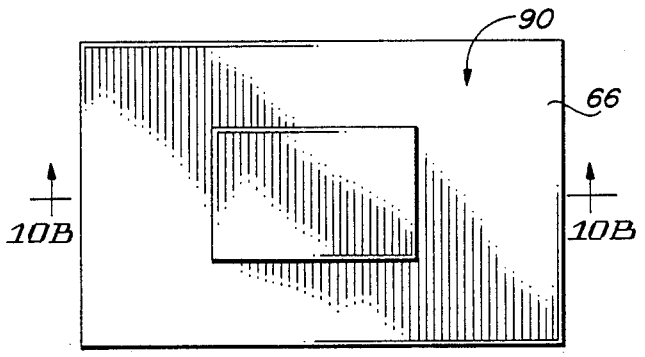
FIGS. 10A and 10B are top and sectional views, respectively, of a wafer containing a tunneling diode in accordance with the present invention.
Figure 10B:
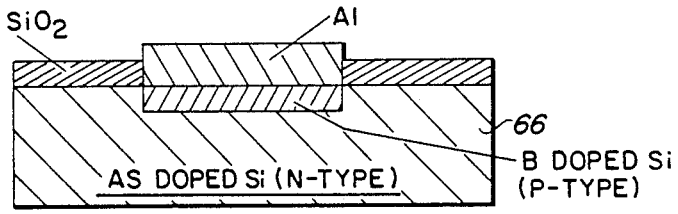

While the diode configurations shown in FIGS. 9A and 9B could be used with either of the two diodes in the series configuration of the present invention, the preferred embodiment of the invention contemplates that such configuration (including outrigger diodes) would be used for the avalanche diode 42 (FIG. 6) and that a standard diode configuration would be used for the zener or tunneling diode 40 (FIG. 6). Top and sectional views, respectively, are shown for a tunneling diode in FIGS. 10A and 10B. Advantageously, the tunneling diode 90 fabricated as shown in FIGS. 10A and 10B can be made on the same n-doped wafer 66 as is used for the avalanche diode 68 of the type shown in FIGS. 9A and 9B. Hence, both diodes can be placed on the same wafer substrate using semiconductor processing techniques well known in the art. This allows both diodes to be realized in an extremely small space.

Figure 12:
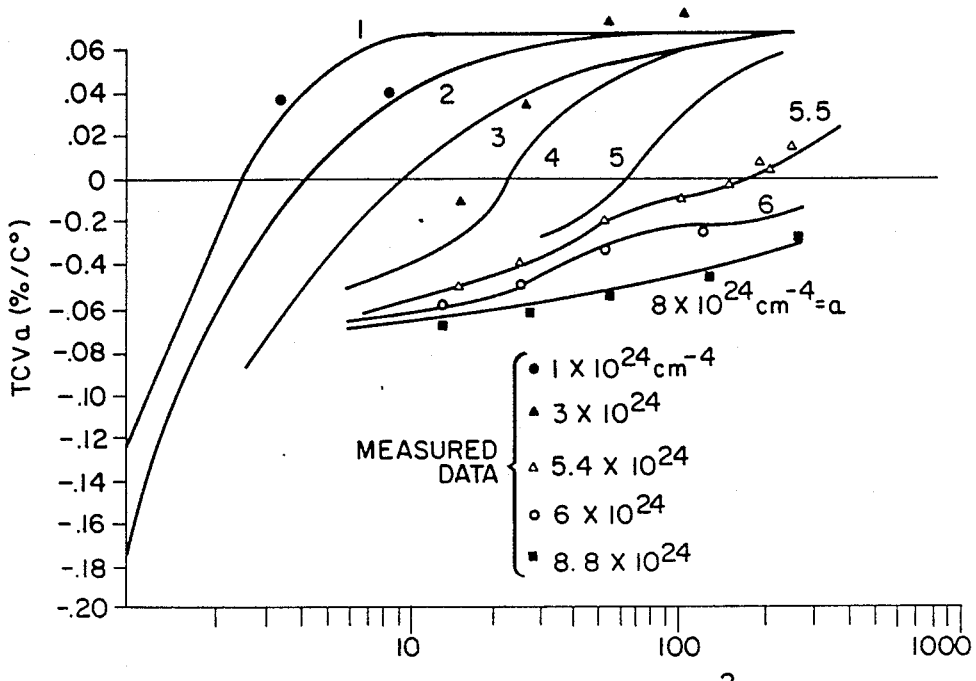
FIG. 12 (PRIOR ART)
FIG. 12 is a similar graph showing the variation in temperature coefficient of voltage versus current density.
Figure 11:
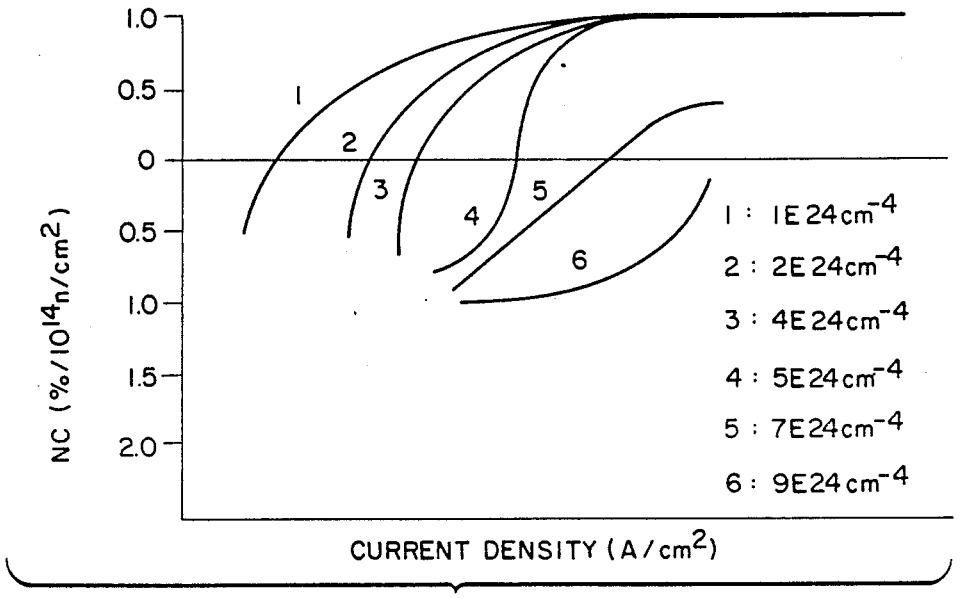
FIG. 11 is a qualitative graph showing the variation in neutron coefficient of voltage versus current density for the voltage reference source of the present invention as a function of various values of grade constant.

Referring next to FIGS. 11 and 12, there are shown various families of curves depicting the relationship between current density and the neutron coefficient of voltage (FIG. 11) and temperature coefficient of voltage (FIG. 12). Each of the curves shown in FIGS. 11 and 12 represents the values obtained for a different grade constant. These figures illustrate that, in general, both the neutron coefficient of voltage and the temperature coefficient of voltage increase as the current density increases. Hence, by selectively increasing the current density (which can be accomplished, for example, using the trimming process described above in connection with FIGS. 9A and 9B) one or both of the desired coefficients of voltage can be selectively adjusted.

A method of effectuating a current density adjustment is thus as follows: An avalanche diode comprising a number of small area diodes in parallel, connected by an aluminum trace over the silicon dioxide on the surface of the silicon chip, is placed in series with a tunnel diode in the configuration shown in FIG. 6. A prescribed biased current, $I_B$ is then caused to flow through both devices, and appropriate measurements are made to determine the temperature coefficient of voltage and/or the neutron coefficient of voltage. (In practice, it is noted that the measurements of temperature coefficient and neutron coefficient can typically be performed on a sampled basis for all devices fabricated from the same lot—that is, whole wafers that are processed in the same batch.) If the temperature coefficient of the avalanche diode is found to be less than the temperature coefficient of the tunnel diode, one or more of the small area diodes from the avalanche diode is disconnected from the others by means of laser burning of the aluminum trace connecting them (similar techniques could also be used to perform this process). Reducing the available area of the avalanche diode in this way increases the current density, since the current through the diode is fixed. Increasing the current density through the avalanche diode increases the temperature coefficient slightly, as shown in FIG. 12. This slight increase permits more exact compensation of the negative temperature coefficient of the tunnel diode. If the temperature coefficient of the avalanche diode is found to be greater than the temperature coefficient of the tunnel diode, then the bias current $I_B$, is decreased to reduce the temperature coefficient of the avalanche diode relative to the tunnel diode. Such a strategy permits very precise compensation of the temperature coefficient.

Likewise, as indicated in FIG. 11, a similar strategy could be used to provide a more precise compensation of the neutron coefficient of voltage. In practice, however, because the neutron coefficient (FIG. 11) more or less tracks the temperature coefficient (FIG. 12), compensation of either the temperature coefficient or the neutron coefficient is performed, and the remaining coefficient is allowed to seek its own level. Achievement of a zero neutron coefficient of voltage is expected to be more critical than achievement of a zero temperature coefficient of voltage for many applications. This is because critical circuits can always be placed in a temperature controlled environment in order to maintain constant diode temperature.

In accordance with the method proposed herein, therefore, the following steps are followed in order to achieve a zero coefficient of voltage. Assuming a circuit configuration such as that shown in FIG. 6, and diode configurations similar to those shown in FIGS. 9A and 9B and 10A and 10B, the neutron coefficient versus neutron fluence for a sample diode drawn from a homogeneous group of diodes is measured. Next, the relationship between the pre-irradiation value of the temperature coefficient of voltage and the neutron coefficient of voltage for devices drawn from this same group is determined. Once this relationship is determined, for the sample diode(s), it can be assumed that this relationship is the same for all the same diodes drawn from the same group. Thus, the next step to select diodes for zero neutron coefficient at the neutron fluence of interest based on the pre-irradiation temperature coefficient of voltage. Finally, diodes are trimmed, as required, in order to achieve a desired pre-irradiation temperature coefficient of voltage using the procedure described previously.

To illustrate this method further, the following example is offered. An avalanche diode consisting of a number of small area diodes in parallel, connected by an aluminum trace over a silicon dioxide on the surface of the silicon chip, is placed in series with a tunnel diode in the configuration shown in FIG. 6. These two diodes are biased at a specified current, e.g., 10 ma. The temperature coefficient of voltage for the avalanche diode and the tunnel diode is determined. If the temperature coefficient of the avalanche diode is less than the temperature coefficient of the tunnel diode, then one or more of the small area diodes from the avalanche diode is disconnected from the others in the original parallel connection by means of laser burning of the aluminum trace connecting them. Reducing the available dipole area of the avalanche diode in this way increases the current density through the avalanche diode, since the current through the diodes is fixed. Increasing the current density through the avalanche diode increases the temperature coefficient slightly, as shown in FIG. 12, which increase allows the temperature coefficients of the avalanche and tunnel diodes to be made substantially equal. If the temperature coefficient of the avalanche diode is found to be greater than the temperature coefficient of the tunnel diode, the bias current, $I_B$, is decreased to reduce the temperature coefficient of the avalanche diode relative to the tunnel diode. If needed (that is, if decreasing the bias current by an available increment causes the temperature coefficient of the avalanche diode to be reduced below that of the tunnel diode) the trimming process above described can be performed.

The described trimming of the avalanche diode to increase the temperature coefficient thereof can also be used to increase the neutron coefficient of the diode as indicated in FIG. 11.

It is noted that the temperature compensated radiation hardened voltage reference circuit of the present invention may be realized using either discrete components or by fabricating the desired diodes on the same silicon substrate. If commercially available diodes are used, representative commercial devices are the ¼ watt silicon zener diodes manufactured by Motorola identified as ¼M2.4AZ10 through ¼M105Z10. Alternatively, custom made diodes tailored to specific applications can be readily fabricated by those skilled in the art.

While the invention described herein has been described with reference to specific embodiments and applications thereof, numerous variations and modifications could be made thereto by those skilled in the art without departing from the spirit and scope of the invention as claimed. Accordingly, the true scope of the invention should be determined with reference to the claims set forth below.

What is claimed is:

1. A temperature compensated voltage reference device comprising:

a series circuit comprising an avalanche diode connected in series with a Schottky diode; and means for passing an electrical current of a prescribed magnitude through said series circuit for operation of said avalanche diode in a reverse biased mode and operation of said Schottky diode in a forward biased mode, said diodes when so biased having opposite temperature coefficients of voltage.

2. The device of claim 1 wherein said opposite temperature coefficients of voltage are of substantially equal magnitude.

3. The device of claim 1 wherein said diodes when so biased also have compensating opposite neutron coefficients of voltage.

4. The device of claim 3 wherein said opposite neutron coefficients of voltage are of substantially equal magnitude.

5. The device of claim 3 wherein the voltage drop across said series circuit does not change by more than one millivolt as a result of being subjected to neutron exposures up to $1\times10^{14}$ n/cm$^2$.

6. The device of claim 1 wherein the temperature coefficient of voltage for the series circuit is less than one mv/°C. over a temperature range of from −25° C. to +125° C.

7. A temperature compensated precision voltage reference device comprising an avalanche diode connected in series circuit with a tunnel diode, said series circuit being connected to a source of electric current of a predetermined magnitude for operation of both of said diodes in the reverse biased mode, said diodes when so biased having compensating opposite temperature coefficients of voltage, said device providing a substantially constant reference voltage measured across said series circuit.

8. The device of claim 7 wherein said opposite temperature coefficients of voltage are of substantially equal magnitude.

9. The device of claim 7 wherein said diodes also have compensating opposite neutron coefficients of voltage when so biased.

10. The device of claim 9 wherein said opposite neutron coefficient of voltage are of substantially equal magnitude.

11. The device of claim 7 wherein said avalanche diode has a grade constant on the order of no more than $1\times10^{24}$ cm$^{-4}$, and said tunneling diode has a grade constant on the order of no less than $1\times10^{24}$ cm$^{-4}$.

12. The device of claim 9 wherein the temperature coefficient of voltage is less than 10 parts per million over a temperature range of from −55° C. to +125° C.

13. The device of claim 9 wherein the neutron coefficient of voltage is less than 10 parts per million for neutron fluences up to about $1\times10^{15}$ n/cm$^2$.

14. A method of matching temperature coefficients of voltage of a pair of diodes connected in series in a series circuit, said pair of diodes comprising a reversed biased avalanche diode and one of either a reversed biased tunneling diode or a forward biased Schottky diode, each of said diodes having a semiconductor construction that includes a dipole area through which a bias current flows, each of said diodes further having a temperature coefficient of voltage that varies with the density of the electrical current flowing through the dipole area, said method comprising the steps of:

(a) passing an electric current of a predetermined magnitude through said series circuit as the bias current;

(b) measuring the temperature coefficient of voltage of each of said diodes while said electric current flows through said series circuit; and (c) adjusting the size of the dipole area, and thereby the current density, of at least one of said diodes, as required, in order to substantially match the temperature coefficients of voltage of the two diodes.

15. The method of claim 14 wherein, if the temperature coefficient of voltage of said avalanche diode is found to be of lesser magnitude than that of said one of said tunneling diode or said Schottky diode, step (c) comprises reducing the size of the dipole area of the avalanche diode to thereby increase the current density within said avalanche diode.

16. The method of claim 14 wherein, if the temperature coefficient of voltage of said avalanche diode is found to be of greater magnitude than that of said one of said tunneling diode or said Schottky diode, step (c) comprises reducing the size of the dipole area of said one of the tunneling or Schottky diode to thereby increase the current density within said one of the tunneling diode or Schottky diode.

17. A method of maximizing the hardness to neutron fluence of a precision voltage reference device, said device comprising a pair of diodes connected in a series circuit and having an electrical current of predetermined magnitude passing therethrough, said pair of diodes comprising a reversed biased avalanche diode and one of a reversed biased tunneling diode or a forward biased Schottky diode said method comprising: substantially matching the temperature coefficients of voltage of said diodes when said current flows therethrough, and maintaining the same current flow through said device, said matching of temperature coefficients causing the neutron coefficients of voltage of said diodes to also substantially match.

18. Diode means comprising a first diode having a dipole area of predetermined size and one or more second diodes each having a dipole area of predetermined smaller size than that of said first diode, said first diode comprising one of a tunneling diode or an avalanche diode, and said one or more second diodes comprising one or more of the other of said tunneling diode of said avalanche diode, said one or more second diodes being connected in parallel circuit relation by means including a severable lead connecting one terminal of each of said second diodes with one terminal of said first diode, the total dipole area of said diode means comprising the sum of the dipole areas of said first and second diodes, said total dipole area being selectively reducible by selective severance of one or more of said severable leads.

19. The diode means of claim 18 further including a substrate common to all of said first and second diodes, said substrate being covered by an insulating layer, said severable lead overlaying said insulating layer.

20. The diode means of claim 18 wherein each of said severable leads is severable by exposure to laser light of a predetermined magnitude.

21. A method of producing a diode pair having a substantially zero neutron coefficient of voltage at a selected neutron fluence level, said diode pair comprising a reversed biased avalanche diode and either a reversed biased tunneling diode or a forward biased Schottky diode, said method comprising the steps of:

(a) measuring the neutron coefficients of voltage versus neutron fluence for sample diodes drawn from two homogeneous groups of diodes, one group comprising tunneling diodes and the other group comprising avalanche diodes;

(b) determining the relationship between the pre-irradiation value of the temperature coefficient of voltage and the neutron coefficient of voltage at said selected neutron fluence level of diodes drain from said groups; and (c) based on the relationship determined in step (b), selecting those diodes whose measured pre-irradiation temperature coefficient of voltage corresponds to substantially zero neutron coefficient of voltage at said selected fluence level.

22. The method of claim 21 further comprising the step of adjusting the size of the dipole area of those diodes selected from said group whose measured pre-irradiation temperature coefficient of voltage corresponds to a value of neutron coefficient of voltage greater than zero, said dipole area size adjustment being that necessary to adjust the temperature coefficient of voltage thereof to that corresponding to substantially zero neutron coefficient of voltage.

23. A precision voltage reference circuit comprising:

a first diode comprising a reversed biased diode operating in an avalanche mode having a prescribed bias current flowing therethrough; and a second diode comprising one of a reversed biased diode operating is a tunneling mode or a forward biased Schottky diode connected in series with said first diode, said prescribed bias current thereby also flowing through said second diode;

said first and second diodes having respective temperature coefficients of voltage that are of opposite polarity and that compensate each other, the net temperature coefficient of said precision voltage reference circuit remaining less than ten parts per million over a prescribed temperature range; and said first and second diodes having respective neutron coefficients of voltage that are of opposite polarity and that compensate each other, the net neutron coefficient of said precision voltage reference circuit remaining less than 100 parts per million over a prescribed range of neutron fluence.

24. The precision voltage reference circuit of claim 23 wherein the temperature coefficient of said first diode can be selectively adjusted to match the temperature coefficient of said second diode by altering the current density through said first diode.

25. The precision voltage reference circuit of claim 24 wherein said first diode comprises a plurality of diode structures connected in parallel, and wherein the current density through said first diode is altered by selectively changing the number of diode structures connected in parallel.

26. The precision voltage reference circuit of claim 23 wherein the temperature coefficient of said first diode can be selectively adjusted to match the temperature coefficient of said second diode by altering the level of said prescribed bias current.

* * * * *

UNITED STATES PATENT AND TRADEMARK OFFICE

CERTIFICATE OF CORRECTION

PATENT NO. : 4,948,989

DATED : 8/14/90

INVENTOR(S) : James P. Spratt

It is certified that error appears in the above-identified patent and that said Letters Patent is hereby corrected as shown below:

Column 3, line 16, change the first occurrence of "the" to --and--.

Column 10, line 42, change "≃ +ppm/°C." to -- ≃ +700ppm/°C.--.

Column 11, line 53, change "cmz" to --$cm^2$--, and same line, insert an end parenthesis after "sec-$cm^2$".

Column 16, line 29, change the third occurrence of "of" to --or--.

Column 16, line 60, change "drain" to --drawn--.

Signed and Sealed this

Third Day of December, 1991

*Attest:*

HARRY F. MANBECK, JR.

*Attesting Officer*

*Commissioner of Patents and Trademarks*